US012618189B2

(12) United States Patent
Christensen et al.

(10) Patent No.: US 12,618,189 B2
(45) Date of Patent: May 5, 2026

(54) LINT FILTER FOR LAUNDRY APPLIANCE HAVING A CLOSABLE FILTERING SPACE FOR CAPTURING LINT PARTICLES

(71) Applicant: WHIRLPOOL CORPORATION, Benton Harbor, MI (US)

(72) Inventors: Mark J. Christensen, Stevensville, MI (US); Kyle J. Carow, Coloma, MI (US); Brendan L. Erickson, Holland, MI (US); Forrest S. McKenzie, Marcellus, MI (US)

(73) Assignee: Whirlpool Corporation, Benton Harbor, MI (US)

( * ) Notice: Subject to any disclaimer, the term of this patent is extended or adjusted under 35 U.S.C. 154(b) by 654 days.

(21) Appl. No.: 18/121,248

(22) Filed: Mar. 14, 2023

(65) Prior Publication Data

US 2023/0340715 A1 Oct. 26, 2023

Related U.S. Application Data

(60) Provisional application No. 63/332,713, filed on Apr. 20, 2022.

(51) Int. Cl.
*D06F 58/22* (2006.01)
*D06F 58/04* (2006.01)

(52) U.S. Cl.
CPC ..... *D06F 58/22* (2013.01); *D06F 58/04* (2013.01)

(58) Field of Classification Search
CPC ..... D06F 58/22; D06F 58/04; D06F 39/10
See application file for complete search history.

(56) References Cited

U.S. PATENT DOCUMENTS

| | | | | |
|---|---|---|---|---|
| 2,509,300 | A * | 5/1950 | Hendrickson | D06F 58/22 55/422 |
| 4,653,200 | A * | 3/1987 | Werner | D06F 58/22 34/604 |
| 4,856,348 | A | 8/1989 | Hall | |
| 6,101,741 | A | 8/2000 | Sears | |
| 11,433,341 | B2 | 9/2022 | Choi et al. | |
| 2014/0208603 | A1* | 7/2014 | Kim | D06F 29/005 34/79 |

(Continued)

FOREIGN PATENT DOCUMENTS

| | | | |
|---|---|---|---|
| CN | 104452236 | A | 3/2015 |
| DE | 8437357 | U1 | 3/1985 |

(Continued)

*Primary Examiner* — David J Laux
(74) *Attorney, Agent, or Firm* — Price Heneveld LLP

(57) ABSTRACT

A lint filter for a laundry appliance includes a handle, a first panel that extends from the handle and has a mesh filtration member, and a second panel that is coupled to the first panel at a hinge member that opposes the handle. The hinge member biases the second panel against the mesh filtration member to define a closed position, and a flow of process air through the mesh filtration member moves the second panel away from the mesh filtration member to define an open position that forms a filtering space for capturing particulate matter from the process air. Upon deactivation of the flow of the process air, the lint filter returns to the closed position that is configured to trap the particulate matter in the filtering space and between the first and second panels.

18 Claims, 8 Drawing Sheets

(56) References Cited

U.S. PATENT DOCUMENTS

| | | | | |
|---|---|---|---|---|
| 2015/0176192 | A1* | 6/2015 | Bison | D06F 58/22<br>34/82 |
| 2020/0129908 | A1 | 4/2020 | Choi et al. | |
| 2022/0298717 | A1* | 9/2022 | MacDonald, III | D06F 58/22 |
| 2022/0396910 | A1* | 12/2022 | Bodine | D06F 58/02 |

FOREIGN PATENT DOCUMENTS

| | | | |
|---|---|---|---|
| EP | 2562304 | B1 | 3/2017 |
| GB | 2091123 | A | 7/1982 |
| WO | 2014006156 | A1 | 1/2014 |

* cited by examiner

LINT FILTER FOR LAUNDRY APPLIANCE HAVING A CLOSABLE FILTERING SPACE FOR CAPTURING LINT PARTICLES

CROSS-REFERENCE TO RELATED APPLICATION

This application claims priority to and the benefit under 35 U.S.C. § 119(e) of U.S. Provisional Patent Application No. 63/332,713, filed on Apr. 20, 2022, entitled LINT FILTER FOR LAUNDRY APPLIANCE HAVING A CLOSABLE FILTERING SPACE FOR CAPTURING LINT PARTICLES, the entire disclosure of which is hereby incorporated herein by reference.

FIELD OF THE DEVICE

The device is generally in the field of laundry appliances, and more specifically, a lint filter for a laundry appliance that includes opposable panels that operate relative to one another to enclose a filtering space between the two panels so that particulate matter can be captured within the filtering space.

SUMMARY OF THE DEVICE

According to an aspect of the present disclosure, a lint filter for a laundry appliance includes a handle, a first panel that extends from the handle and has a mesh filtration member, and a second panel that is coupled to the first panel at a hinge member that opposes the handle. The hinge member biases the second panel against the mesh filtration member to define a closed position, and a flow of process air through the mesh filtration member moves the second panel away from the mesh filtration member to define an open position that forms a filtering space for capturing particulate matter from the process air. Upon deactivation of the flow of the process air, the lint filter returns to the closed position that is configured to trap the particulate matter in the filtering space and between the first and second panels.

According to another aspect of the present disclosure, a laundry appliance includes a blower that delivers process air through an airflow path that is disposed within an outer cabinet. A drum defines a processing space that treats articles, wherein the airflow path includes the processing space. A lint filter is selectively disposed within the airflow path. The lint filter includes a first panel that selectively extends into the airflow path and has a filtration member and a handle, and a second panel that is coupled to the first panel at a hinge member that opposes the handle. The hinge member biases the second panel against the first panel to define a closed position. Activation of the blower directs the process air through the filtration member and also biases the second panel away from the first panel to define an open position that forms a filtering space between the second panel and the filtration member. Upon deactivation of the blower, the second panel returns to the closed position that traps particulate matter within the filtering space and between the second panel and the filtration member.

According to another aspect of the present disclosure, a filtration system for an appliance includes a blower that delivers process air through an airflow path. A particulate filter is selectively disposed within the airflow path. The particulate filter includes a first panel that extends between a handle and a hinge member, a mesh filtration member that is disposed within the first panel that is configured to separate particulate matter from the process air to define captured particulate matter, and a second panel that is coupled to the hinge member and cooperates with the mesh filtration member to define a filtering space therebetween. The hinge member biases the second panel to a closed position proximate the mesh filtration member. Activation of the blower directs the process air through the filtering space and defines an increased air pressure within the filtering space that moves the second panel to an open position that expands the filtering space. Upon deactivation of the blower, the second panel is biased to the closed position that traps the captured particulate matter within the filtering space and between the second panel and the mesh filtration member.

These and other features, advantages, and objects of the present disclosure will be further understood and appreciated by those skilled in the art by reference to the following specification, claims, and appended drawings.

Figure 1:
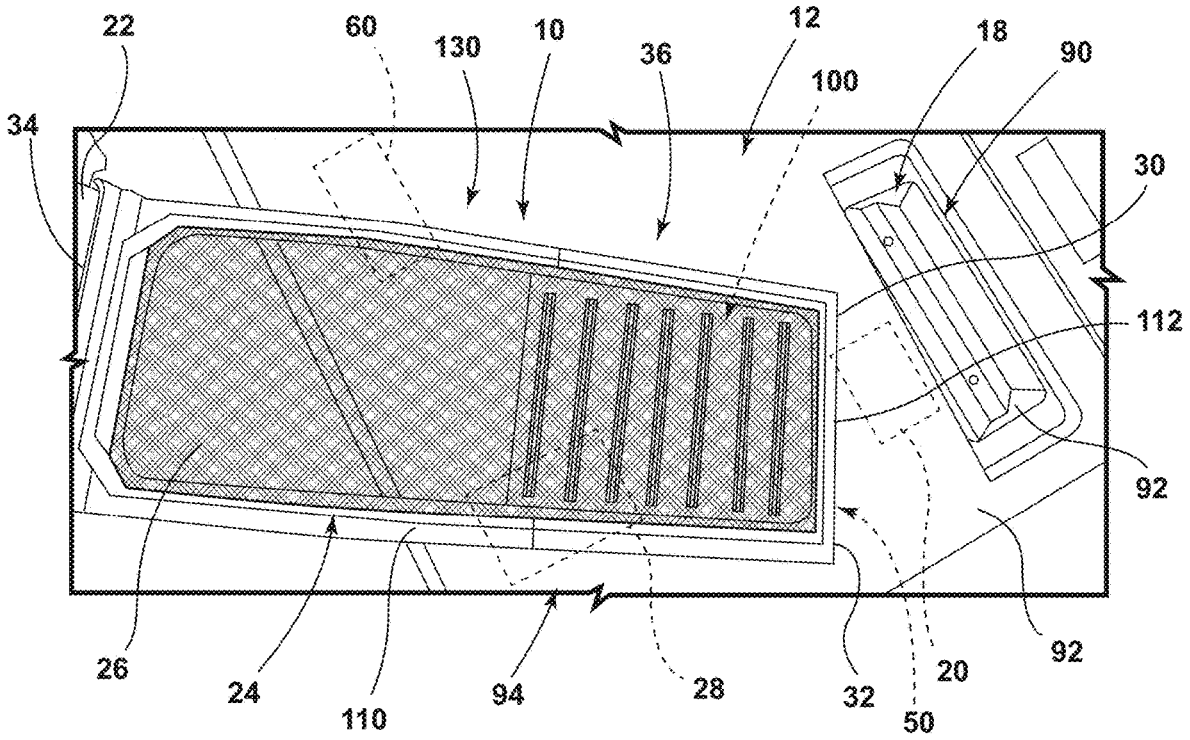
FIG. 1 is a perspective view of an aspect of the lint filter separated from a filter receptacle of a laundry appliance.
Figure 2:
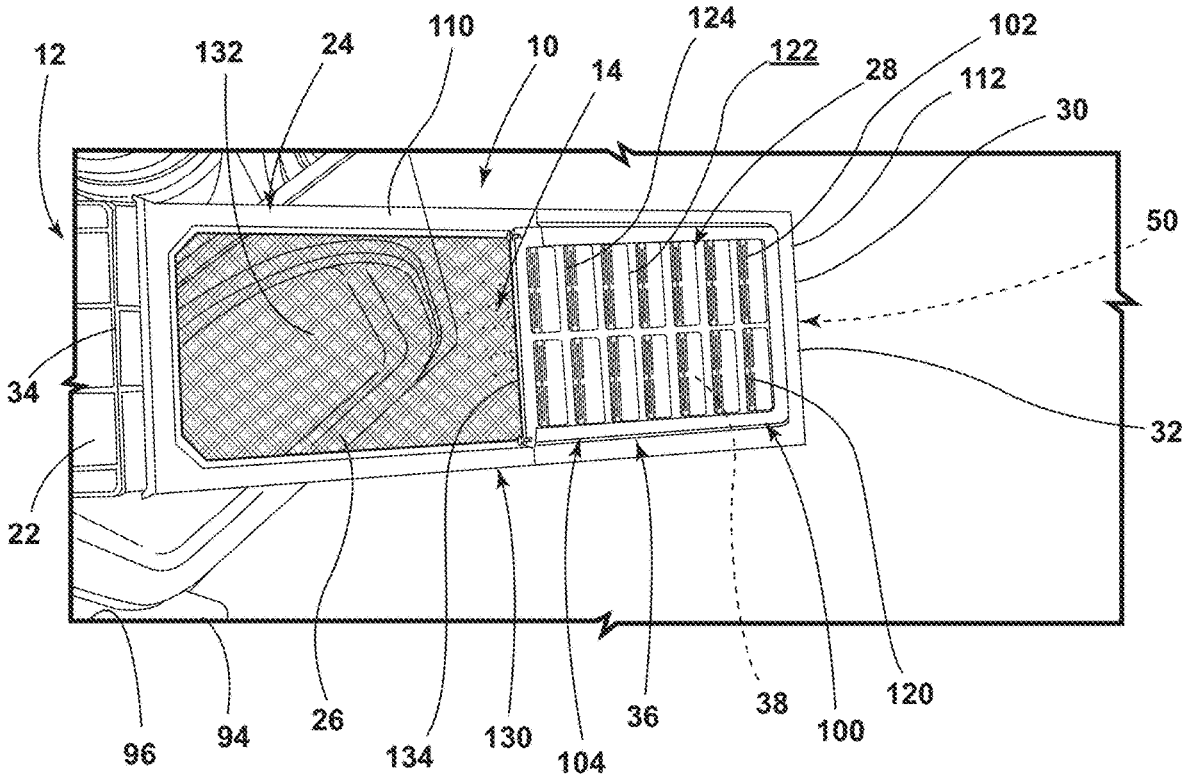
FIG. 2 is a perspective view of the lint filter shown in a closed position with lint particles captured within the filtering space.
Figure 3:
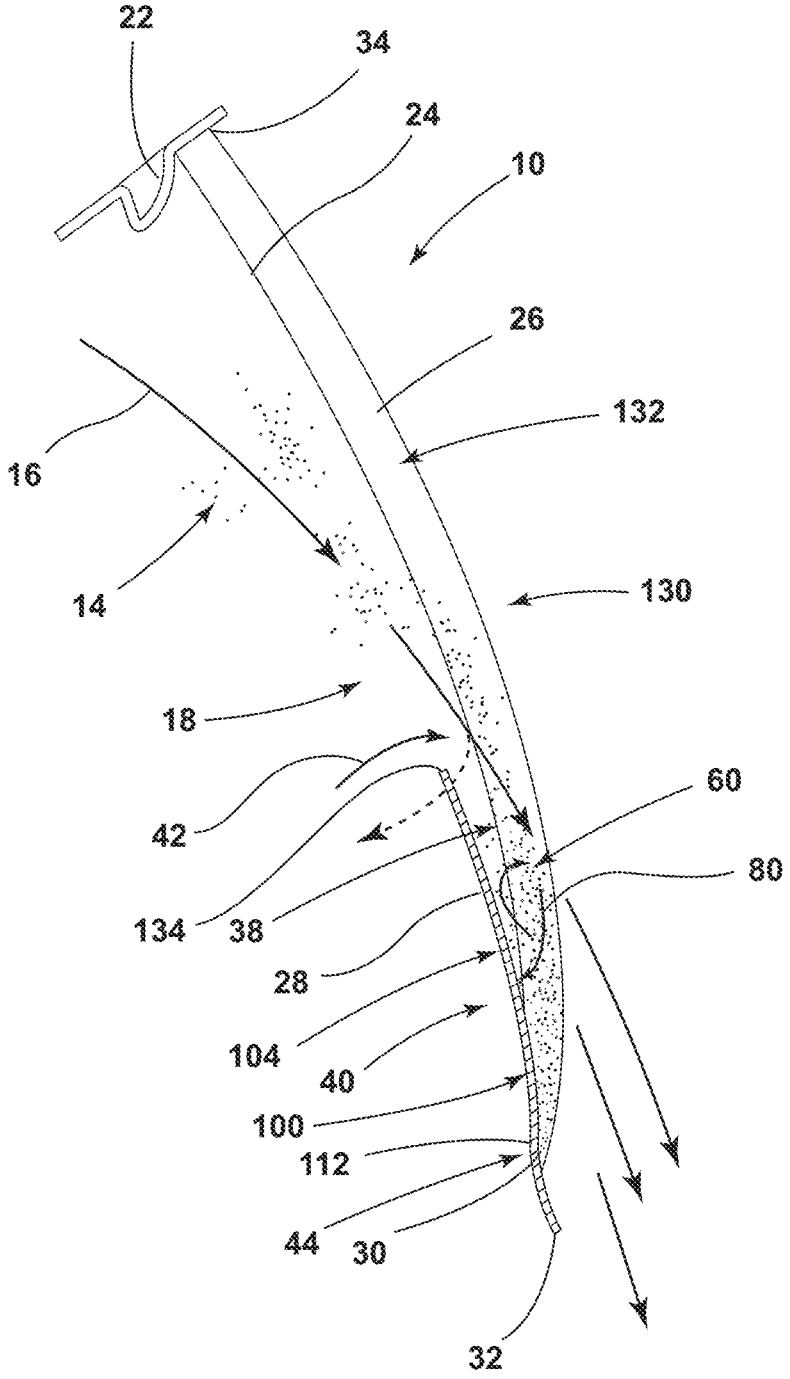
FIG. 3 is a schematic diagram illustrating an aspect of the lint filter and showing operation of the lint filter as process air moves therethrough.
Figure 4:
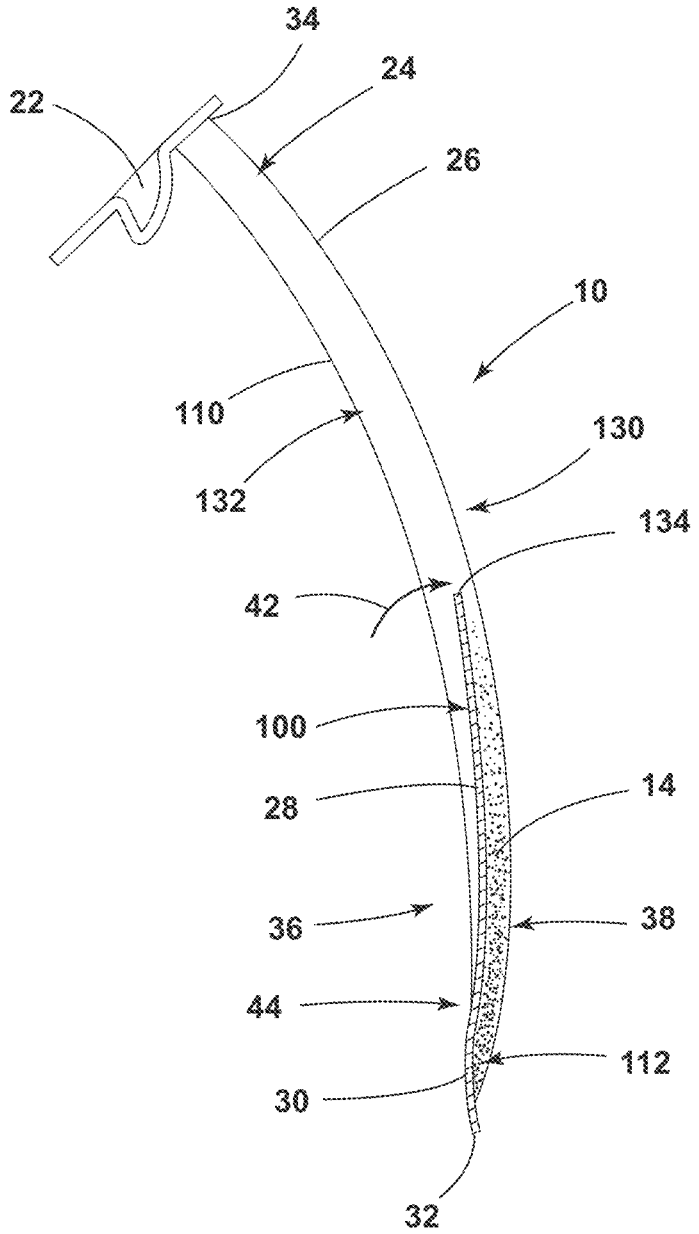
FIG. 4 is a schematic diagram of the lint filter of FIG. 3 and showing the lint particles captured within a filtering space after the blower for the appliance is deactivated.
Figure 5:
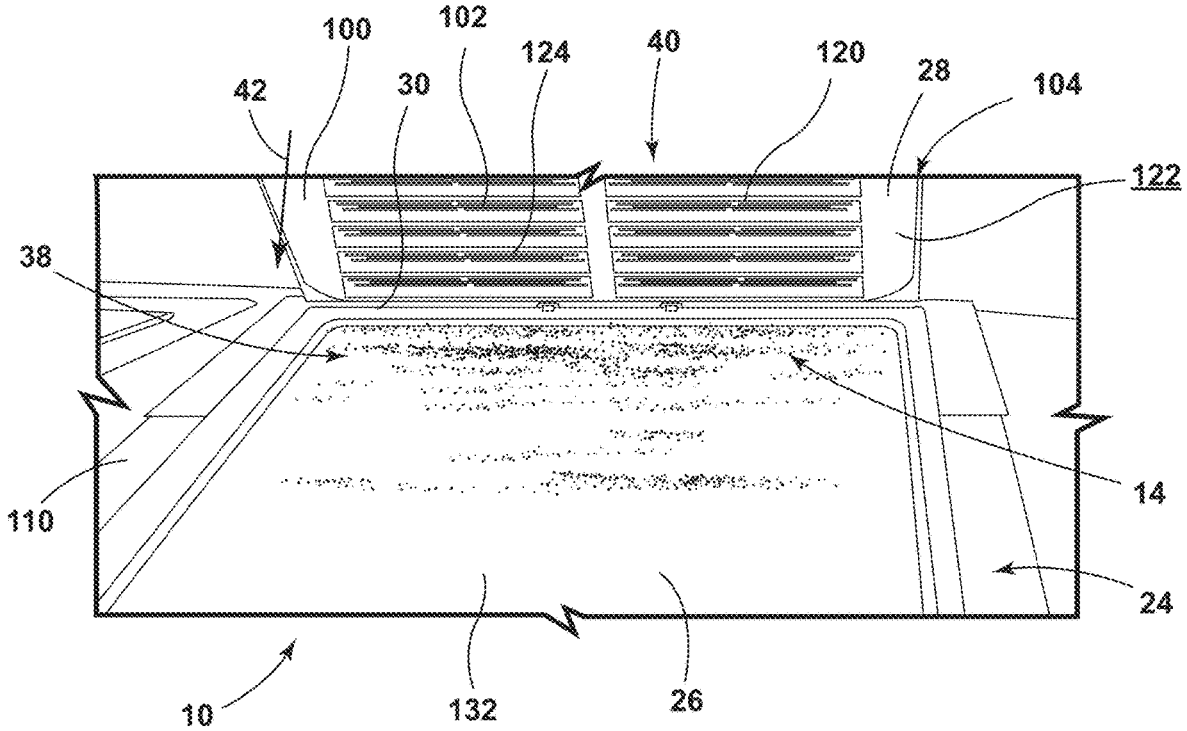
FIG. 5 is a perspective view of the lint filter of FIG. 2 and showing captured lint particles within the filtering space.
Figure 6:
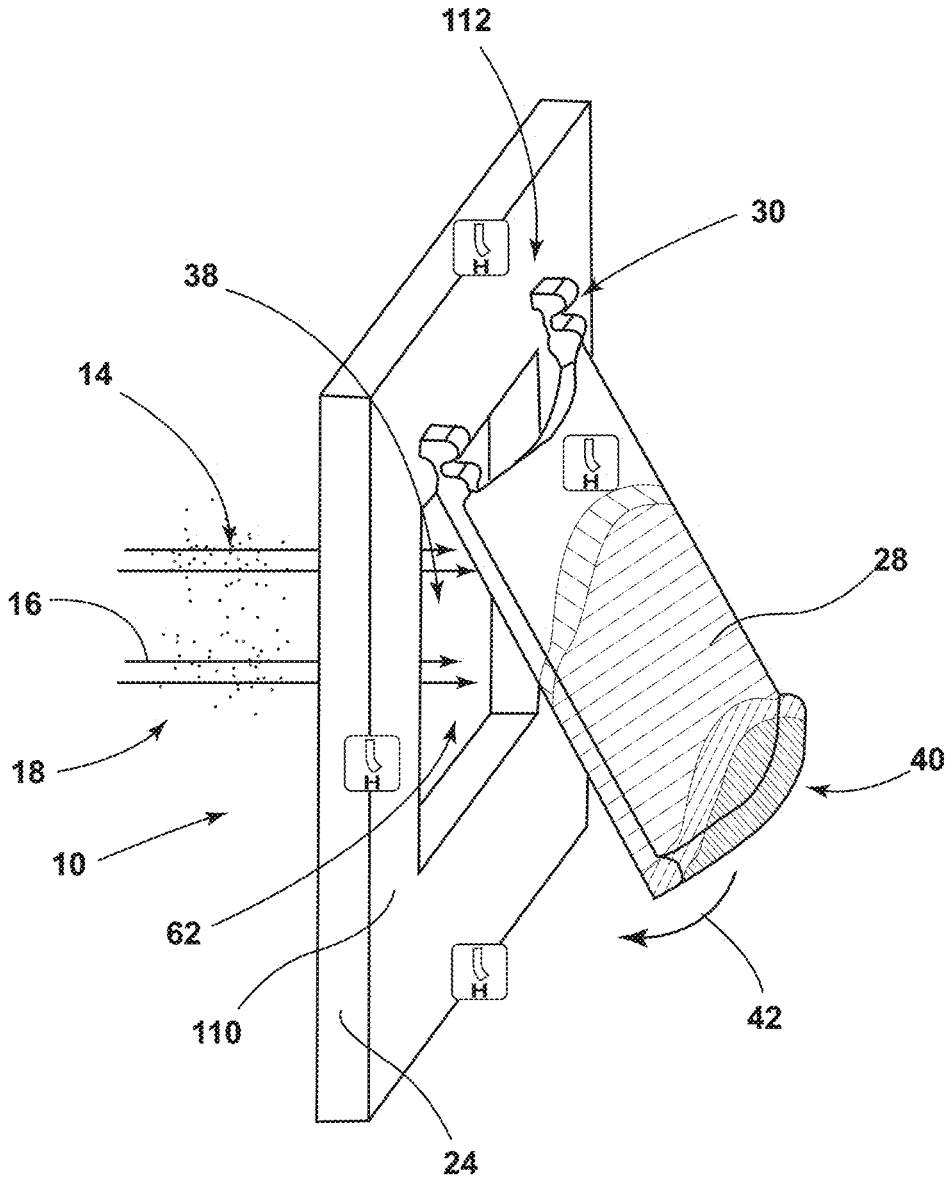
FIG. 6 is a schematic diagram illustrating operation of the second panel relative to the first panel as process air moves through the lint filter.
Figure 7:
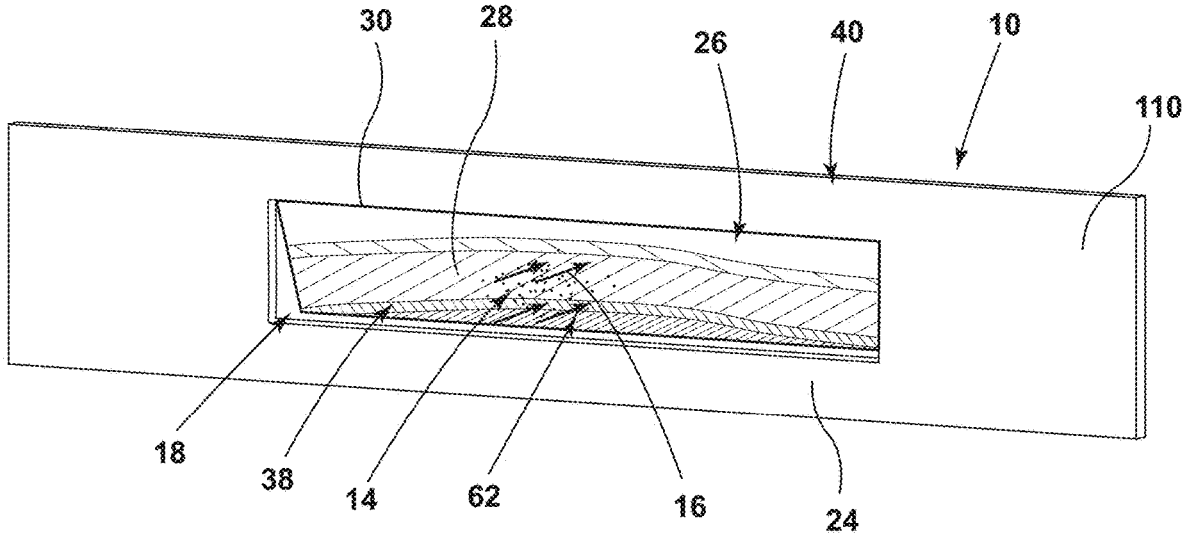
FIG. 7 is a schematic diagram illustrating operation of the second panel relative to the first panel as process air moves through the lint filter.
Figure 8:
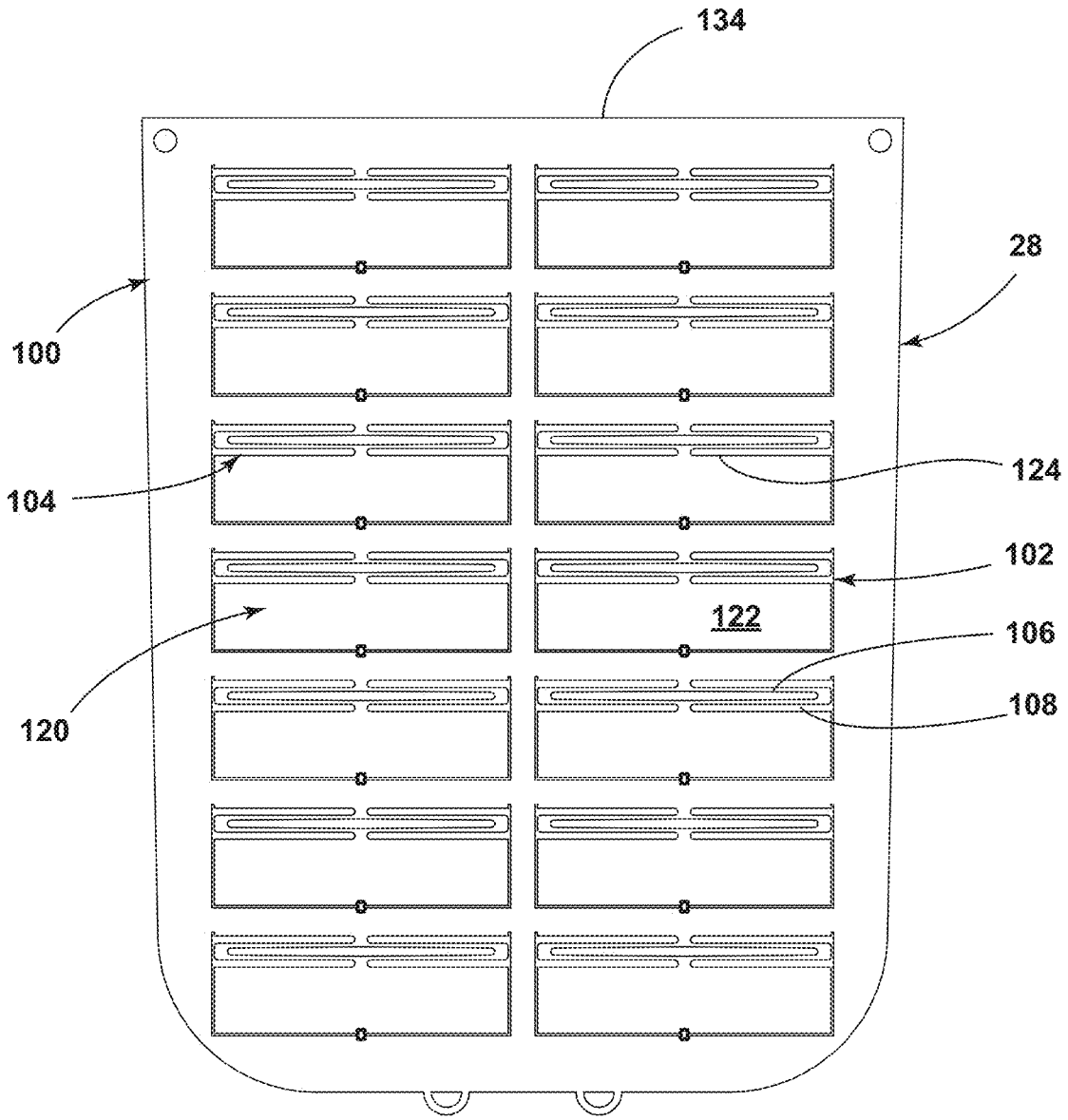
FIG. 8 is a perspective view of an aspect of the second panel for the lint filter that is attached to the first panel at a hinge member.

The components in the figures are not necessarily to scale, emphasis instead being placed upon illustrating the principles described herein.

DETAILED DESCRIPTION

The present illustrated embodiments reside primarily in combinations of method steps and apparatus components related to a lint filter for a laundry appliance that includes a filtering first panel and an operable second panel that operates under air pressure to an open position for capturing particulate matter, such as lint particles, and also closed when the flow of air stops to contain the particulate matter within an enclosed filtering space. Accordingly, the apparatus components and method steps have been represented, where appropriate, by conventional symbols in the drawings, showing only those specific details that are pertinent to understanding the embodiments of the present disclosure so as not to obscure the disclosure with details that will be readily apparent to those of ordinary skill in the art having the benefit of the description herein. Further, like numerals in the description and drawings represent like elements.

For purposes of description herein, the terms "upper," "lower," "right," "left," "rear," "front," "vertical," "horizontal," and derivatives thereof shall relate to the disclosure as oriented in FIG. 1. Unless stated otherwise, the term "front" shall refer to the surface of the element closer to an intended viewer, and the term "rear" shall refer to the surface of the element further from the intended viewer. However, it is to be understood that the disclosure may assume various alternative orientations, except where expressly specified to the contrary. It is also to be understood that the specific devices and processes illustrated in the attached drawings, and described in the following specification are simply exemplary embodiments of the inventive concepts defined in the appended claims. Hence, specific dimensions and other physical characteristics relating to the embodiments disclosed herein are not to be considered as limiting, unless the claims expressly state otherwise.

The terms "including," "comprises," "comprising," or any other variation thereof, are intended to cover a non-exclusive inclusion, such that a process, method, article, or apparatus that comprises a list of elements does not include only those elements but may include other elements not expressly listed or inherent to such process, method, article, or apparatus. An element preceded by "comprises a . . . " does not, without more constraints, preclude the existence of additional identical elements in the process, method, article, or apparatus that comprises the element.

Referring now to FIGS. 1-8, reference numeral 10 generally refers to a lint filter that can be selectively installed or otherwise disposed within a filtration system for an appliance, typically in the form of a laundry appliance 12 for capturing particulate matter 14, such as lint particles, that are moved along with process air 16 through an airflow path 18 during operation of a blower 20 for dehumidifying articles within the laundry appliance 12. Typically, when the blower 20 is activated, the blower 20 delivers process air 16 through the airflow path 18 that includes a processing space 60. This processing space 60 can be within a drum, such as a rotating drum or other container that defines the processing space 60 that treats the articles being processed. According to various aspects of the device, the lint filter 10, also referred to herein as a particulate filter, includes a handle 22 and a filtering first panel 24 that extends from the handle 22. The first panel 24 typically includes a mesh filtration member 26 that is used for capturing particulate matter 14 while allowing filtered process air 16 to move therethrough. An operable second panel 28 is coupled to the first panel 24 at a hinge member 30. The hinge member 30 is positioned at a first end 32 of the first panel 24 and the handle 22 is positioned at a second end 34 of the first panel 24. Accordingly, the hinge member 30 opposes the handle 22 with respect to the first panel 24. The hinge member 30 biases the second panel 28 against the mesh filtration member 26 to define a closed position 36. A filtering space 38 is defined between the first and second panels 24, 28. A flow of process air 16 through the mesh filtration member 26 biases the second panel 28 away from the mesh filtration member 26 to define an open position 40 of the lint filter 10. In this open position 40, process air 16 moves through the mesh filtration member 26 and the mesh filtration member 26 separates particulate matter 14 from the process air 16. In this manner, the particulate matter 14 is captured within the mesh filtration member 26 and within the filtering space 38. When the blower 20 of the laundry appliance 12 is deactivated, the flow of process air 16 stops. This deactivation of the blower 20 allows the increase in air pressure 62 to diminish and a biasing force 42 of the hinge member 30 allows the lint filter 10 to be returned to the closed position 36. In this manner, the second panel 28 engages the first panel 24 and traps the now captured particulate matter 14 between the first and second panels 24, 28 and in the filtering space 38.

During operation of the blower 20, process air 16 moves through the airflow path 18 of the appliance 12 for drying articles within a processing space 60. Process air 16 travels through the mesh filtration member 26. Due to the mesh size of the mesh filtration member 26, at least a portion of the process air 16 is temporarily trapped between the first and second panels 24, 28. This results in an increased air pressure 62 between the first and second panels 24, 28. This increased air pressure 62 overcomes the biasing force 42 of the hinge member 30 and causes the second panel 28 to move away from the first panel 24 to define the open position 40 of the lint filter 10.

In certain aspects of the device, movement of process air 16 through the lint filter 10 causes eddies 80 of the process air 16 and other minute airflows to form between the first and second panels 24, 28. These eddies 80 generate the increased air pressure 62 between the first and second panels 24, 28 that moves the second panel 28 to the open position 40.

In this open position 40, it is contemplated that the second panel 28 engages a portion of the airflow path 18. In this manner, all or substantially all of the process air 16 is directed through the mesh filtration member 26 and primarily through the filtering space 38 defined between the first and second panels 24, 28 while the lint filter 10 is in the open position 40.

Referring again to FIGS. 1-8, the laundry appliance 12 includes a filter receptacle 90 that selectively receives the lint filter 10. This filter receptacle 90 forms a portion of the airflow path 18 through which process air 16 is delivered for drying articles within the processing space 60. In certain aspects of the device, the filter receptacle 90 can be within a top panel 92 of the appliance 12. In such an aspect of the device, the lint filter 10 can be extracted from the top panel 92 where the handle 22 of the lint filter 10 is exposed at the exterior of an outer cabinet 94 for the appliance 12. It is also contemplated that the lint filter 10 can be positioned within a portion of the processing space 60. In certain aspects, the lint filter 10 can be positioned within a filter receptacle 90 that is positioned within a lower portion of an aperture 96 that provides access to the processing space 60.

Referring again to FIGS. 1-8, the lint filter 10 is configured to be placed within the filter receptacle 90 of the laundry appliance 12. In this manner, the lint filter 10 can be placed within and extracted from the filter receptacle 90 for removing captured particulate matter 14 from the filtering space 38.

As exemplified in FIGS. 1-8, the second panel 28 is attached to the first panel 24 at the hinge member 30. It is contemplated that this hinge member 30 can be in the form of a living hinge 44. This living hinge 44 can be formed between the second panel 28 and a frame 110 of the first panel 24 that surrounds the mesh filtration member 26 of the first panel 24. It is also contemplated that the hinge member 30 can be in the form of a mechanical hinge where the first panel 24 and second panel 28 meet. The hinge member 30 can include a biasing mechanism 112 that biases the second panel 28 toward the first panel 24. In this manner, the second panel 28 returns to the closed position 36 of the lint filter 10. In this closed position 36, the filtering space 38 can be generally enclosed between the first and second panels 24, 28. This biasing mechanism 112 can be in the form of a spring, a formed living hinge 44, another elastic member, the force of gravity, combinations thereof and other similar mechanisms for biasing the second panel 28 to the closed position 36 proximate the mesh filtration member 26.

It is contemplated that the hinge member 30 can be incorporated within a single and continuous member that forms the frame 110 of the first panel 24 and the second panel 28. In such an aspect of the device, the seam that is formed between the first panel 24 and the second panel 28 can define the living hinge 44. The hinge member 30 in the form of the living hinge 44 can also be incorporated into either the first panel 24 or the second panel 28. In this aspect of the device, the hinge member 30 can be an extension of the first panel 24 that is then attached to the second panel 28. The hinge member 30 can also be an extension of the second panel 28 that is then attached to the first panel 24. Where the hinge member 30 is an extension of the second panel 28, it is contemplated that the second panel 28 having the hinge member 30 can be an after-market component that is attached to the first panel 24.

The hinge member 30 can also be part of a separate component, such as a third panel 50, that connects with each of the first panel 24 and the second panel 28. In such an aspect of the device, the hinge member 30 can include a first hinge panel and a second hinge panel that are joined at the hinge mechanism. As described herein, the hinge mechanism can be in the form of a living hinge 44, a mechanical hinge having a hinge pin or other rotational interface, or other similar hinge configurations.

When the blower 20 for the laundry appliance 12 is deactivated and particulate matter 14 is captured within the filtering space 38, the second panel 28 is biased toward the first panel 24. Through this configuration, the second panel 28 traps particulate matter 14 within the filtering space 38. As the lint filter 10 is extracted from the filter receptacle 90, minimal amounts of particulate matter 14, if any, are allowed to be dislodged from the mesh filtration member 26 as the lint filter 10 is extracted from the filter receptacle 90. Certain amounts of particulate matter 14 may be dislodged as the user separates the second panel 28 from the first panel 24 and removes captured particulate matter 14 from the mesh filtration member 26. Using this configuration, a minimal amount of particulate matter 14 are allowed to fly freely through the space surrounding the laundry appliance 12 as the user removes captured particulate matter 14 from the lint filter 10. This creates a minimal amount of mess and debris around the laundry appliance 12 during use of the dryer.

As exemplified in FIGS. 1, 2, 5 and 8, the second panel 28 can include various structural formations 120 that are defined within the outer surface 122 of the second panel 28. These structural formations 120 can include fine slots 124 that allow a certain amount of process air 16 to move therethrough and provide additional filtering capability within the filtering space 38. In certain instances, the structural formations 120 can increase the formation of eddies 80 that increase the air pressure 62 within the filtering space 38. Using this configuration, the amount of air pressure 62 formed between the first and second panels 24, 28 and in the filtering space 38 can be increased such that the blower 20 moving at a slower speed can provide a sufficient amount of process air 16 to bias a second panel 28 away from the first panel 24 to define the open position 40 of the lint filter 10. It is contemplated that the surface of the second panel 28 can take various forms and can include these structural formations 120 in the outer surface 122 of the second panel 28. It is also contemplated that the second panel 28 can be smooth or have a rough or textured outer surface 122 that can take various forms and configurations for allowing the process air 16 to bias the second panel 28 towards the open position 40, during operation of the blower 20.

Referring again to FIGS. 1, 2, 5 and 8, the second panel 28 includes a body portion 100 and a plurality of apertures 102 defined within the body portion 100. These apertures 102 are formed within the structural formations 120 of the body portion 100 for the second panel 28 and define a secondary filtration member 104. This secondary filtration member 104 assists in separating particulate matter 14 from the process air 16. The apertures 102 that are defined within the structural formations 120 are defined by a resilient frame 106 that surrounds the aperture 102. This resilient frame 106 also defines a filtration slot 108 that assists in cooperating with the process air 16 to move the second panel 28 to the open position 40. The resilient frames 106 for the respective apertures 102 of the plurality of apertures 102 are typically integrally formed with the body portion 100 of the second panel 28. In this manner, the second panel 28 and the structural formations 120 that are formed therein are typically made of a single and continuous member that is molded as a single piece.

According to various aspects of the device, the first panel 24 extends between the handle 22 and the hinge member 30. The second panel 28 extends from the hinge member 30 to a medial section 130 of the first panel 24. Through this configuration, the mesh filtration member 26 of the first panel 24 includes the filtering space 38 that is defined between the first and second panels 24, 28 and also defines an air directing space 132 that is positioned between the handle 22 and an outer edge 134 of the second panel 28. This air directing space 132 directs process air 16 into the filtering space 38 between the first and second panels 24, 28 to allow for the build-up of air pressure 62 that moves the second panel 28 to the open position 40 and expands the filtering space 38 to receive the process air 16.

According to various aspects of the device, the lint filter 10 provides for an operable second panel 28 that can be used for containing captured particulate matter 14 within a filtering space 38 and preventing these particulate matter 14 from being dislodged as the lint filter 10 is removed from the filter receptacle 90. It is also contemplated that the lint filter 10 described herein can be used within any one or more of various appliances 12. Such appliances 12 can include, but are not limited to, vented dryers, recirculating dryers, heat pump dryers, condensing dryers, combination washing and drying appliances, air handling units, and other similar appliances that filter a flow of air by using a filtration member. It is also contemplated that the appliance 12 may include multiple lint filters 10 that may include filtration members 26 having different mesh sizes.

According to the various aspects of the device, the particulate filter, such as the lint filter 10, can be incorporated within any one of a variety of appliances 12. Such appliances 12 can include, but are not limited to, laundry appliances, refreshing appliances, dishwashers, air handling units, air conditioning units, vent hoods, refrigerating units and other appliances that include a filtration mechanism for an air handling system.

The invention disclosed herein is further summarized in the following paragraphs and is further characterized by combinations of any and all of the various aspects described therein.

According to an aspect of the present disclosure, a lint filter for a laundry appliance includes a handle, a first panel that extends from the handle and has a mesh filtration member, and a second panel that is coupled to the first panel at a hinge member that opposes the handle. The hinge member biases the second panel against the mesh filtration member to define a closed position, and a flow of process air through the mesh filtration member moves the second panel away from the mesh filtration member to define an open position that forms a filtering space for capturing particulate matter from the process air. Upon deactivation of the flow of the process air, the lint filter returns to the closed position that is configured to trap the particulate matter in the filtering space and between the first and second panels.

According to another aspect, the lint filter is configured to be placed within a filter receptacle of said laundry appliance.

According to another aspect, the filter receptacle is positioned within a top panel of a cabinet of said laundry appliance.

According to another aspect, the hinge member is a mechanical hinge that connects the first panel and the second panel.

According to another aspect, the mechanical hinge includes a biasing mechanism that biases the first panel and the second panel toward the closed position.

According to another aspect, the first panel includes a frame that surrounds the mesh filtration member, and the hinge member is attached to the frame.

According to another aspect, the frame and the second panel are a single and continuous member, and the hinge member is a living hinge that is defined between the first panel and the second panel.

According to another aspect, the hinge member is a living hinge that is defined within the second panel.

According to another aspect, the second panel that has the hinge member is attached to the first panel.

According to another aspect, the second panel that has the hinge member is an after-market component that is attached to the first panel.

According to another aspect, the second panel includes a body portion and a plurality of apertures that are defined within the body portion that define a secondary filtration member.

According to another aspect, each aperture of the plurality of apertures includes a resilient frame that defines a filtration slot that assists in cooperating with the process air to move the second panel to the open position.

According to another aspect, the resilient frame of each aperture is integrally formed with the body portion of the second panel.

According to another aspect, the hinge member is a third panel that extends between the first panel and the second panel.

According to another aspect, the third panel includes the hinge member in a form of a living hinge.

According to another aspect of the present disclosure, a laundry appliance includes a blower that delivers process air through an airflow path that is disposed within an outer cabinet. A drum defines a processing space that treats articles, wherein the airflow path includes the processing space. A lint filter is selectively disposed within the airflow path. The lint filter includes a first panel that selectively extends into the airflow path and has a filtration member and a handle, and a second panel that is coupled to the first panel at a hinge member that opposes the handle. The hinge member biases the second panel against the first panel to define a closed position. Activation of the blower directs the process air through the filtration member and also biases the second panel away from the first panel to define an open position that forms a filtering space between the second panel and the filtration member. Upon deactivation of the blower, the second panel returns to the closed position that traps particulate matter within the filtering space and between the second panel and the filtration member.

According to another aspect, the lint filter is selectively received within a receptacle that extends into the airflow path.

According to another aspect, the receptacle is defined within a top panel of the outer cabinet.

According to another aspect of the present disclosure, a filtration system for an appliance includes a blower that delivers process air through an airflow path. A particulate filter is selectively disposed within the airflow path. The particulate filter includes a first panel that extends between a handle and a hinge member, a mesh filtration member that is disposed within the first panel that is configured to separate particulate matter from the process air to define captured particulate matter, and a second panel that is coupled to the hinge member and cooperates with the mesh filtration member to define a filtering space therebetween. The hinge member biases the second panel to a closed position proximate the mesh filtration member. Activation of the blower directs the process air through the filtering space and defines an increased air pressure within the filtering space that moves the second panel to an open position that expands the filtering space. Upon deactivation of the blower, the second panel is biased to the closed position that traps the captured particulate matter within the filtering space and between the second panel and the mesh filtration member.

According to another aspect, the particulate filter is disposed within the airflow path through an opening in an outer cabinet that surrounds the airflow path.

It will be understood by one having ordinary skill in the art that construction of the described disclosure and other components is not limited to any specific material. Other exemplary embodiments of the disclosure disclosed herein may be formed from a wide variety of materials, unless described otherwise herein.

For purposes of this disclosure, the term "coupled" (in all of its forms, couple, coupling, coupled, etc.) generally means the joining of two components (electrical or mechanical) directly or indirectly to one another. Such joining may be stationary in nature or movable in nature. Such joining may be achieved with the two components (electrical or mechanical) and any additional intermediate members being integrally formed as a single unitary body with one another or with the two components. Such joining may be permanent in nature or may be removable or releasable in nature unless otherwise stated.

It is also important to note that the construction and arrangement of the elements of the disclosure as shown in the exemplary embodiments is illustrative only. Although only a few embodiments of the present innovations have been described in detail in this disclosure, those skilled in the art who review this disclosure will readily appreciate that many modifications are possible (e.g., variations in sizes, dimensions, structures, shapes and proportions of the various elements, values of parameters, mounting arrangements, use of materials, colors, orientations, etc.) without materially departing from the novel teachings and advantages of the subject matter recited. For example, elements shown as integrally formed may be constructed of multiple parts or elements shown as multiple parts may be integrally formed, the operation of the interfaces may be reversed or otherwise varied, the length or width of the structures and/or members or connector or other elements of the system may be varied, the nature or number of adjustment positions provided between the elements may be varied. It should be noted that the elements and/or assemblies of the system may be constructed from any of a wide variety of materials that provide sufficient strength or durability, in any of a wide variety of colors, textures, and combinations. Accordingly, all such modifications are intended to be included within the scope of the present innovations. Other substitutions, modifications, changes, and omissions may be made in the design, operating conditions, and arrangement of the desired and other exemplary embodiments without departing from the spirit of the present innovations.

It will be understood that any described processes or steps within described processes may be combined with other disclosed processes or steps to form structures within the scope of the present disclosure. The exemplary structures and processes disclosed herein are for illustrative purposes and are not to be construed as limiting.

What is claimed is:

1. A lint filter for a laundry appliance, the lint filter comprising:

a handle;

a first panel that extends from the handle and having a mesh filtration member; and a second panel that is coupled to the first panel at a hinge member that opposes the handle, wherein the hinge member biases the second panel against the mesh filtration member to define a closed position, and wherein a flow of process air through the mesh filtration member moves the second panel away from the mesh filtration member to define an open position that forms a filtering space for capturing particulate matter from the process air, and where upon deactivation of the flow of the process air, the lint filter returns to the closed position that is configured to trap the particulate matter in the filtering space and between the first and second panels.

2. The lint filter of claim 1, wherein the lint filter is configured to be placed within a filter receptacle of said laundry appliance.

3. The lint filter of claim 2, wherein the filter receptacle is positioned within a top panel of a cabinet of said laundry appliance.

4. The lint filter of claim 1, wherein the hinge member is a mechanical hinge that connects the first panel and the second panel.

5. The lint filter of claim 4, wherein the mechanical hinge includes a biasing mechanism that biases the first panel and the second panel toward the closed position.

6. The lint filter of claim 1, wherein the first panel includes a frame that surrounds the mesh filtration member, and wherein the hinge member is attached to the frame.

7. The lint filter of claim 6, wherein the frame and the second panel are a single and continuous member, and wherein the hinge member is a living hinge that is defined between the first panel and the second panel.

8. The lint filter of claim 1, wherein the hinge member is a living hinge that is defined within the second panel.

9. The lint filter of claim 1, wherein the second panel having the hinge member is attached to the first panel.

10. The lint filter of claim 9, wherein the second panel having the hinge member is an after-market component that is attached to the first panel.

11. The lint filter of claim 1, wherein the second panel includes a body portion and a plurality of apertures defined within the body portion that define a secondary filtration member.

12. The lint filter of claim 11, wherein each aperture of the plurality of apertures includes a resilient frame that defines a filtration slot that assists in cooperating with the process air to move the second panel to the open position.

13. The lint filter of claim 12, wherein the resilient frame of each aperture is integrally formed with the body portion of the second panel.

14. The lint filter of claim 1, wherein the hinge member is a third panel that extends between the first panel and the second panel.

15. The lint filter of claim 14, wherein the third panel includes the hinge member in a form of a living hinge.

16. A laundry appliance comprising:

a blower that delivers process air through an airflow path disposed within an outer cabinet;

a drum that defines a processing space that treats articles, wherein the airflow path includes the processing space;

a lint filter selectively disposed within the airflow path, the lint filter comprising:

a first panel that selectively extends into the airflow path and having a filtration member and a handle; and a second panel that is coupled to the first panel at a hinge member that opposes the handle, wherein the hinge member biases the second panel against the first panel to define a closed position, and wherein activation of the blower directs the process air through the filtration member and also biases the second panel away from the first panel to define an open position that forms a filtering space between the second panel and the filtration member, and where upon deactivation of the blower, the second panel returns to the closed position that traps particulate matter within the filtering space and between the second panel and the filtration member.

17. The laundry appliance of claim 16, wherein the lint filter Is selectively received within a receptacle that extends into the airflow path.

18. The laundry appliance of claim 17, wherein the receptacle is defined within a top panel of the outer cabinet.

* * * * *